United States Patent [19]

Papoff et al.

[11] 4,056,258

[45] Nov. 1, 1977

[54] ACTUATING DEVICE WITH ELECTRONIC CONTROL FOR INJECTORS OF LIQUID MIXERS

[75] Inventors: Paolo Papoff; Basilio Morelli; Dante Guidarini, all of Bari, Italy

[73] Assignee: Centro Nazionale Delle Richerche, Rome, Italy

[21] Appl. No.: 749,391

[22] Filed: Dec. 8, 1976

Related U.S. Application Data

[63] Continuation-in-part of Ser. No. 541,321, Jan. 15, 1975, abandoned.

[51] Int. Cl.[2] ..... B01F 15/00

[52] U.S. Cl. ..... 366/160; 366/143

[58] Field of Search ..... 259/1 R, 2, 4, 11, 18, 259/48, 60, 98, DIG. 19, DIG. 46; 222/137, 333; 335/234, 266, 268

[56] References Cited

U.S. PATENT DOCUMENTS

| | | | |
|---|---|---|---|
| 1,433,951 | 10/1922 | Kendall | 335/268 |
| 2,530,682 | 11/1950 | Coldsnow | 222/333 |
| 2,946,488 | 7/1960 | Kraft | 222/137 X |
| 3,746,216 | 7/1973 | Frederick | 222/145 |
| 3,981,487 | 9/1976 | Papoff | 259/4 R |

FOREIGN PATENT DOCUMENTS

| | | | |
|---|---|---|---|
| 1,190,571 | 5/1970 | United Kingdom | 259/2 |

*Primary Examiner*—Edward J. McCarthy

[57] ABSTRACT

An actuating device comprising injectors connected with chambers for liquids to be mixed and with analyzer members by means of switchable shut-off members. Movable assemblies of the injectors are kinematically connected with a common keeper acted upon by one or two electromagnets. The device is equipped with means to modify the displacement speed of the keeper and hence the liquid mixing speed, by the use of a special electronic control circuit that energizes the electromagnet or magnets at varying speeds.

12 Claims, 5 Drawing Figures

ACTUATING DEVICE WITH ELECTRONIC CONTROL FOR INJECTORS OF LIQUID MIXERS

This is a Continuation-In-Part of Applicant's copending patent application Ser. No. 541,321, filed Jan. 15, 1975, titled "Device For Actuating the Injectors of Liquid Mixers Used in Chemical-Physical Analyses Utilizing the Stopped Flow Method," now abandoned.

The invention relates to a device to actuate the injectors of mixing apparatus used in chemical/physical analyses based on quick kinematic reactions which occur before and after mixing two liquids, the device being equipped with a novel electronic control arrangement.

In certain types of chemical/physical analyses, for example those utilizing thermic, photometric, conductometric detectors, etc., mixing apparatus commonly known as stop-flow apparatus are used; these are provided with a mixing chamber connected at one side to an observation cell and at the other side, through a plurality of conduits, to injector/feeder devices, suitably actuated so as to quickly inject the components of the mixture into the chamber.

The object of this invention is to provide an actuating device for the injectors/feeders, which permits at the same time to vary and control the action and injection rate of the liquids involved from start to finish and, in particular, to impart a high acceleration velocity to the liquids toward the end of the injection phase, in due consideration of the chemical and physical characteristics of the liquids under examination.

Another object of the invention is to provide a device which is simple and easy to construct, reliable to operate and apt to provide a rapid connection of the feeder-/injector elements first with the reservoirs for the component liquids of the mixture and successively with the mixing chamber.

Essentially the device according to this invention, employing injectors that are connected, via switchable devices, to the containers for the liquids to be mixed and, via a mixing chamber, to the analyzer, is characterized in that the moving parts of the injectors are kinematically connected with a common keeper of at least one electromagnet, for simultaneous actuation of the moving parts and admission of the liquids into the mixing chamber.

The inventive actuating device is also characterized by a novel electronic control arrangement that provides a predetermined displacement speed for the keeper, in conjunction with other novel and useful features.

It should be understood that the inventive concept is subject to various forms of embodiment, without however departing from the spirit and scope of the invention. For example, the device may be provided with a number of electromagnets operating in the desired succession of the keeper, connected to movable parts of the injectors, to inject the liquids into the mixing chamber at different flow rates.

Furthermore, the electromagnet may be combined with elements apt to conveniently control flux intensity and hence the action of this on the keeper, to change the injection flow rate of the fluids into the mixing chamber.

The control elements may be of a type suitable to vary the magnetic flux as a function of the distance determined from time to time between the pole extensions and the keeper of the electromagnet or, in like manner, the keeper of the electromagnet may be operably connected with fluid-pressure elements apt to govern the travel of the keeper.

The invention will now be described with reference to the attached drawings which illustrate, by way of example, a preferred, exemplary embodiment of the actuating device with electronic control, specifically:

Figure 1:
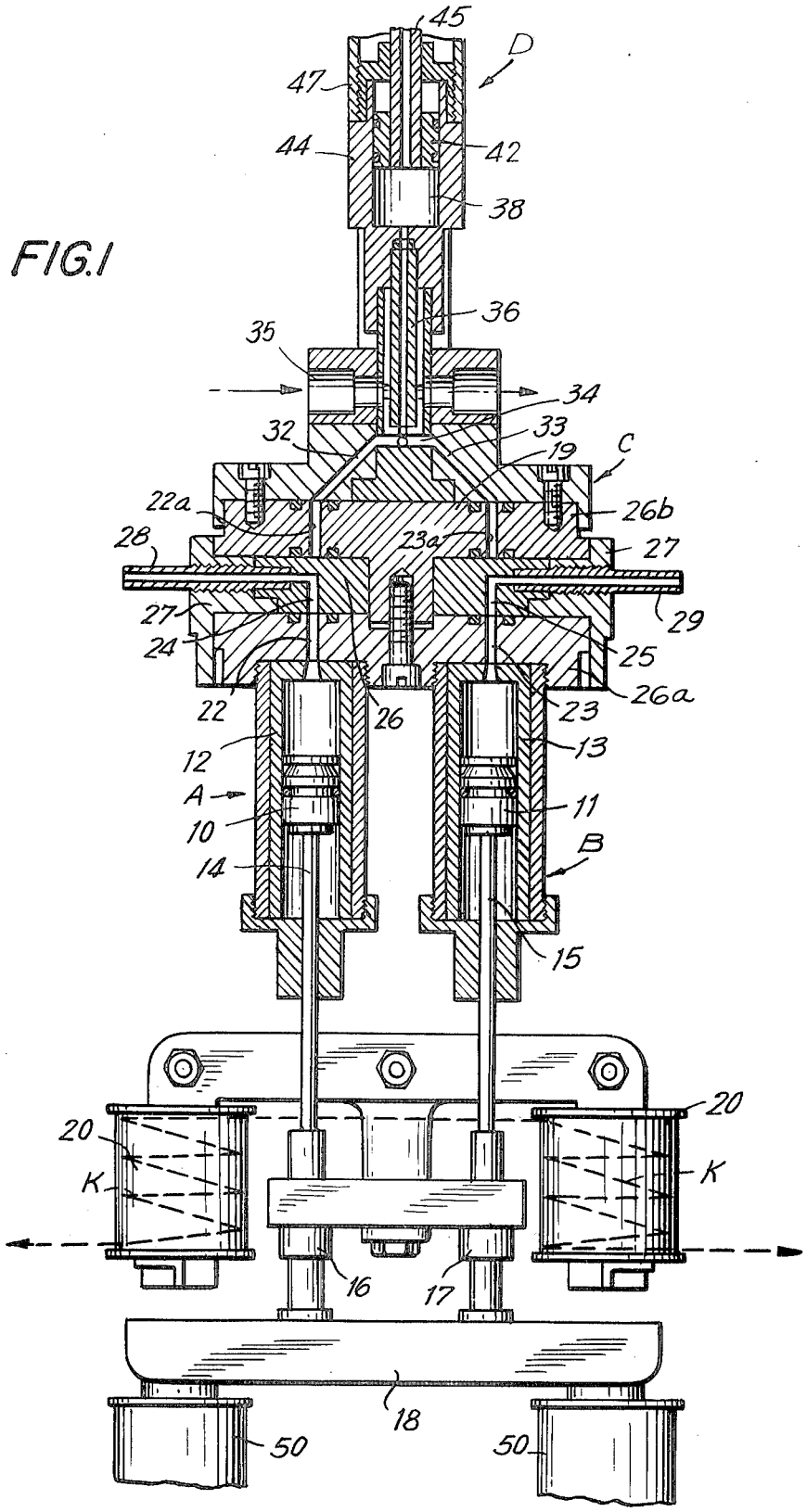
FIG. 1 is a schematic view, in cross-section, of the mechanical arrangement of the inventive actuating device.
Figure 2:
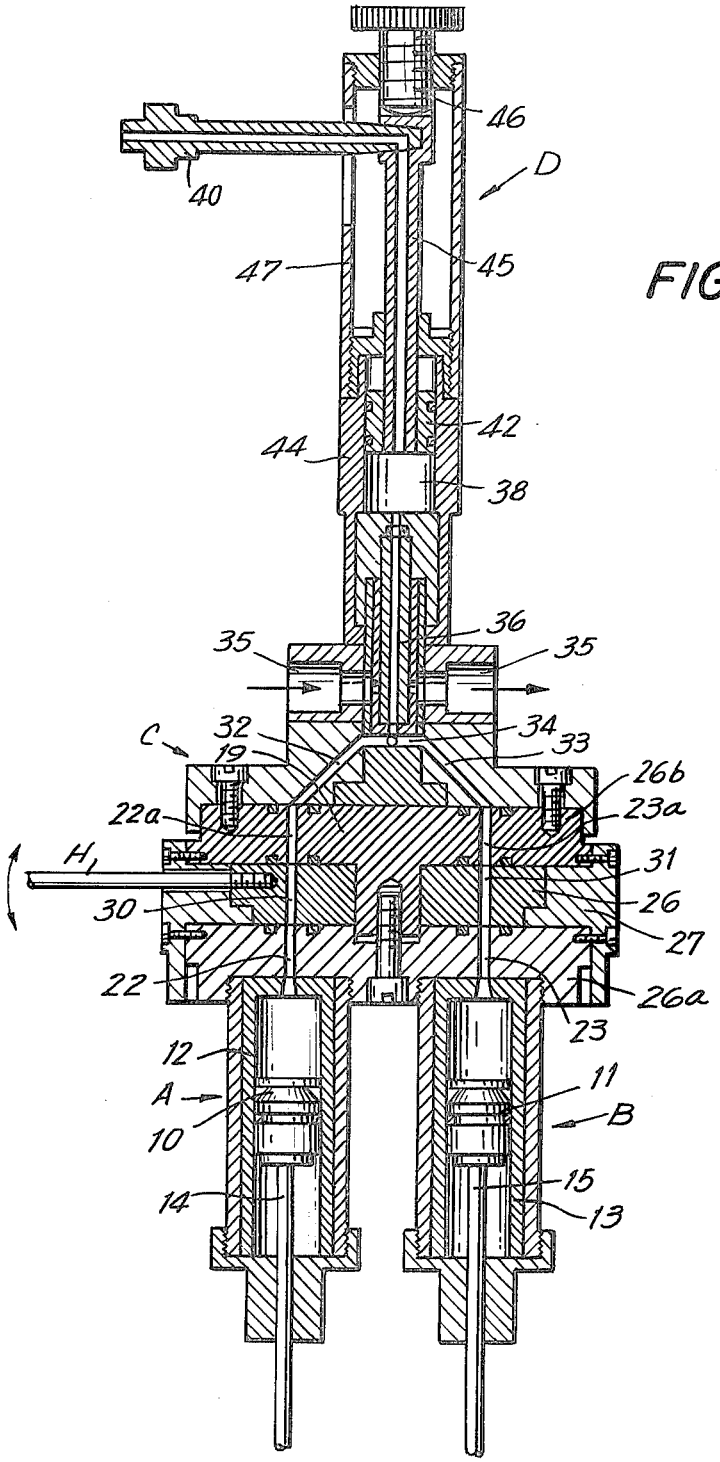
FIG. 2 is a further sectional view of the inventive device in which switchable shut-off means are used that are offset at an angle of 90°.

In FIGS. 1 and 2, the mechanical part of the inventive actuating device with electronic control is shown, two injectors being identified with letters A and B, while letter C identifies a suitable shut-off means, and letter D a detector mechanism pertaining to an analyzer assembly, not shown in further detail in the drawings. Toward the bottom of FIG. 1, two exemplary electromagnets K are shown which could however be combined, to be described somewhat later in respect to the mechanism as well as the schematic and detailed electronic circuits that appear in FIGS. 4 and 5, respectively.

The structure of the injectors A, B is identical, hence only one will be described. Specifically, pistons 10, 11 operate in respective cylinders 12, 13, stems 14, 15 of which pistons are linked by guide elements 16, 17 to a common keeper or movable armature 18 of electromagnets 20 of a suitable type to conveniently actuate the injectors A, B. It will be understood that the electromagnets 20 are equivalents of the schematically shown "coils" K as they appear in FIGS. 4 and 5. The keeper 18 suitably closes the protruding poles of the electromagnets.

The upper chamber of the cylinder-piston assembly 10 . . . 13 communicates via conduits 22, 23 with elbow-shaped conduits 24, 25 of a movable part 19 of the shut-off device C, held from outside by a ring 27.

The movable part 19 is actuated by convenient means and may be moved about 90°, as can be seen when comparing FIGS. 1 and 2. Ring 27 is provided with fittings 28, 29 in diametrically opposite positions for the connection of tubes leading to reservoirs that are not shown in FIG. 1 and which contain in a conventional manner the two liquids to be examined.

Movable part 19 is provided with further conduits *22a, 23a* (offset at an angle of 90° with respect to conduits 24, 25, as shown in FIG. 2); the conduits may however by aligned at one end with the interior of cylinders 12, 13, and at the other end with conduits 32, 33, both emptying into a mixing chamber 24, associated with an observation cell 36 of the detector D, the chamber being provided with windows 35 for a light beam to pass therethrough in a known manner.

In the detector unit D, the chamber 34 leads into an expansion chamber 38 connected by a union of fitting 40 to a drain; the expansion chamber is of the variable-volume type and its top is closed by a piston 42 operating in a cylinder 44. A stem 45 of the piston is hollow in the axial sense and connects with the union 40.

An adjustment screw 46, held in an extension 47 of the cylinder 44, acts as a travel limiter for piston 42; by adjusting the screw, the volume of chamber 38 may be varied as required. The observation cell 36 is of a suitable type, e.g. as disclosed in the U.S. Pat. No. 3,981,487 of Sept. 21, 1976 of two of the present co-inventors, titled "Device for Mixing Liquids in Kinetic Reactions Observed by the Method Known as Stopped Flow".

The device is complete with means to shift the two pistons 10, 11 in a direction opposite to that in which they are shifted by the action of electromagnets 20. In the exemplary illustration of FIG. 1, the means may consist of a further electromagnet or two magnets 20, opposite to and aligned with the pole extensions of the electromagnets 20, so that keeper 18 may shift from the poles.

The device is also provided with control means such as suitable switches operable in a sequence set to realize the desired cycles.

Referring to FIG. 2, it can be seen that the shut-off means C is equipped with a movable member 26, having a grip H for the actuation thereof. This member 26 has two groups of openings, namely those described with reference to numbers 24, 25 in FIG. 1, and through openings 30, 31 as shown in the alternative position of FIG. 2. It can be seen that in FIG. 1, the conduits 22, 23 are linked to the fittings 28, 29 respectively, leading to the explained reservoirs. In the position displaced by 90°, FIG. 2 shows how the conduits 22, 23 are directly linked by the intermediary of the openings 30, 31 to the further conduits *22a, 23a,* leading to the conduits 32, 33 and eventually emptying into the mixing chamber 34. The arrangement identified by letter C also has respective bottom and top end plates *26a, 26b* in which the openings or passages are provided, as illustrated.

The operation of the described device of FIGS. 1 and 2 is as follows: On starting, pistons 10, 11 are in a position of maximum lift, and keeper 18 is in contact with the poles of electromagnets 20.

The switchable shut-off device C is set into the position shown in FIG. 1 in which the chambers of cylinders 12, 13 are connected with the fittings 28, 29 and hence with the containers of the liquids to be examined.

In this position the operator may manually move the keeper 18 downward, also be energizing the electromagnet 50, thereby to draw, by suction, predetermined quantities of the liquids to be examined into the chambers of the cylinders 12, 13. The quantities may be varied at will by conveniently limiting the travel of pistons 10, 11. Successively, the operator rotates the unit C by 90°, by means of the grip H, as shown in FIG. 2, in order to place cylinders 12, 13 in communication with the mixing chamber 34.

After this, the operator may admit the two liquids into the chamber 34, by energizing the magnets 20 to shift the keeper 18 at the required speed, reference being had later to the speed control in accordance with the circuitry of FIGS. 4 and 5. As a result, pistons 10, 11 will inject the two liquids into chamber 34, and the mixing and/or reaction between the liquids may be conveniently observed through windows 35 in detector unit D.

Figure 5:
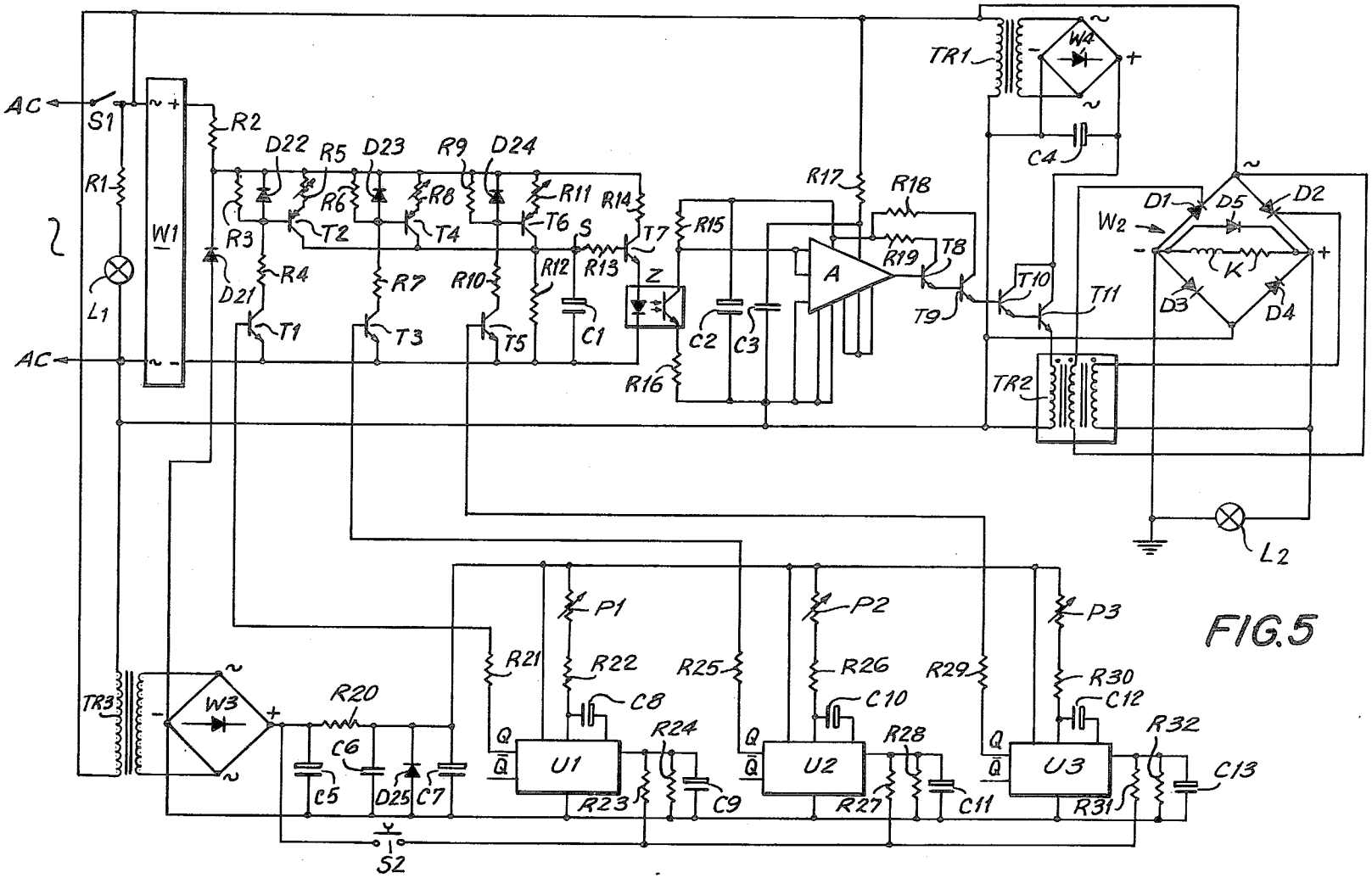
FIG. 5 is a detailed electronic circuit diagram that incorporates the unit of FIG. 4 together with other, more specific particulars, for feeding the electromagnet.

The circuitry of FIG. 5 allows the present invention to inject the liquids into the chamber 34 conveniently and in the proper lapse of time to meet with specific requirements of a given type of analysis. In practice, and in most cases, a certain initial injection velocity for the liquids of the mixture is called for, with a progressive increase of that velocity up to maximum, toward the end of the injection phase.

According to a basic concept of the inventive actuating device, these conditions can be met by the use of electromagnets in which the movement of the keepers varies with accelerated motion; i.e. with equal intensity of the magnetic field, acceleration increases inversely with respect to distance.

It is evident that magnets 20 may be equipped with means to modify the velocity of keeper 18 from start to finish of its travel. Such means may consist, for example, of start-circuit rings or secondary windings in the magnetic circuitry of the magnets 20; however such means may also consist of pneumatic-type fluid-pressure actuated devices. The means may also be of the electromagnetic type, in which case the magnet 50 may be utilized, its electric supply being conveniently controlled to regulate the travel of keeper 18.

The inventive device may be provided, moreover, with means to monitor and control the injection-velocity variables to obtain a reproduction of dead time, and to permit extrapolation for a dead time equal to zero by increasing the velocity of the liquids under examination.

Figure 3:
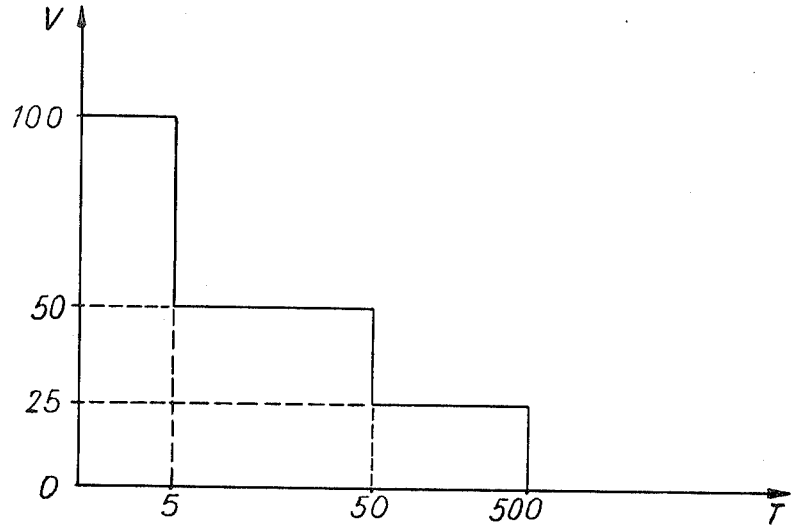
FIG. 3 is a diagram showing how the feed voltage and the time are varied, during which the voltage is applied to the windings of an electromagnet in the inventive device, to be explained later in full detail.

It can be seen from FIG. 3 that the time T required to actuate the electromagnets K is inversely proportional to the voltage V applied thereto. For example, 100 volts may require an actuation of 5 milliseconds, while 50 volts require a longer time, say of 50 milliseconds, and so on.

Figure 4:
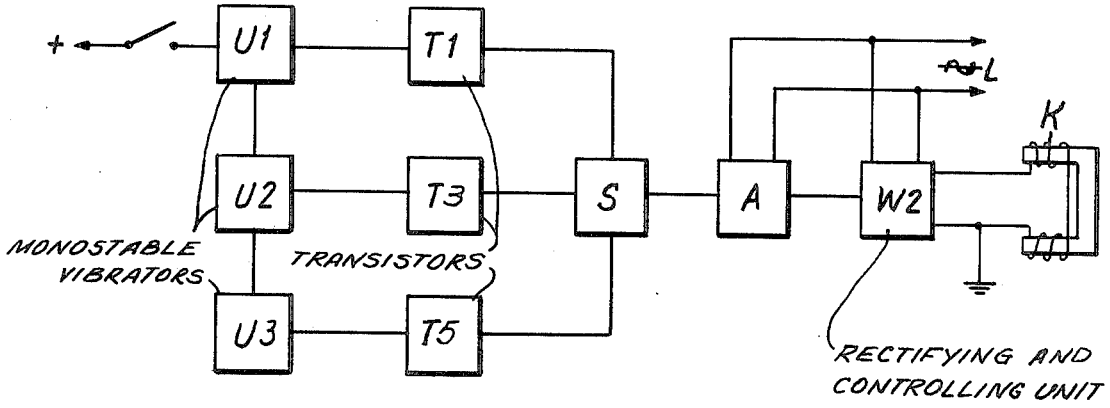
FIG. 4 is an electrical, schematic block diagram of a feeding unit for the electromagnet that forms part of the actuating device.

The feeder schematically illustrated in FIG. 4 includes a number of monostable vibrators U1, U2 and U3, the number of which can be varied according to the requirements of the particular application. The vibrators (also shown in FIG. 5 in the bottom half thereof) are adjustable independently from one another in relation to their time constants, each of them determining exactly the respective time of the various voltage levels of the feeding voltages, to reach successively the windings of the electromagnets K.

These vibrators feed respective amplifier stages constituted schematically by transistors T1, T3 and T5, while the outlets of the amplifiers all lead to the same point or adder unit S where the signals furnished by the amplifiers are summed up so as to form a single signal that presents the desired course. The latter is of course the one illustrated by the diagram of FIG. 3, supposing that the feed of the electromagnet is realized by means of progressively decreasing voltages, namely in accordance to the three steps that correspond to the three units U1/T1 . . . as shown in FIG. 4.

The outlet of the unit S leads to a rectifying unit W2 through a zero-crossing amplifier A (AC voltage being fed simultaneously to both), the unit W2 being designed to control the power delivered, thus feeding the windings of the electromagnets K as necessary.

Referring to FIG. 5, it will be seen that the afore-mentioned vibrators U1 through U3 lead with their terminals Q to the respective transistors T1, T3 and T5 in the upper left-hand portion of the circuit diagram. The summing occurs at point S, as will be explained later, through the intermediary of transistor circuits to be described later in more detail. Through other circuit elements, similarly to be described, the combined signal reaches the schematically illustrated amplifier A. The output of the latter is fed toward the rectifying unit W2, including a diode circuit to be described later, and which has the two electromagnetic coils K across its DC terminals. It should be understood that in the event of only one electromagnet 20 or K, a single coil would be fed by the unit W2.

In order to prevent that the control of high powers, even if developed for very short times only, could be the cause of transients (due to additional currents at the opening and closing of the circuits), which could cause troubles in the electric circuit, the explained amplifier A is inserted between the output of the adder (point S) and the input of the rectifying unit W2. As mentioned before, the amplifier is of the zero-crossing type, designed to intervene when the feeding line voltage passes through the zero value.

Referring again to the simplified block diagram of FIG. 4, the resulting signal obtained from the sum of the signals produced by the vibrators U1 . . . controls the unit W2, which latter consists of elements for the adjustment of the bridge power, formed with two diodes and two S.C.R.'s. This unit, among others, offers the advantage of feeding high powers over controlled times to the electromagnet or magnets K. It is possible during the maximum peak of the feeding voltage to attain powers in the range of 2 to 4 kW, without need to integrate the device with other power stages which, beyond being very expensive, would require considerable space and special controls. The electronic circuit of FIG. 5 has the task of controlling and rectifying at the same time the voltage that is derived directly from an AC input (left-hand top of FIG. 5) and led to the electromagnets K (toward the right-hand top).

The specific electronic circuitry of FIG. 5 of course includes the major units that were described in connection with FIG. 4. In FIG. 5, S1 denotes a main switch inserted in the AC line, while S2 is a normally open pushbutton switch that causes the devices A, W2, etc. to be energized. In the circuits of the vibrators U1 through U3, the elements P1, P2 and P3 are conventional potentiometers by means of which the times of intervention of the control device are set.

Variable resistors R5, R8, R11 (in the top transistor circuits) serve to regulate the amplitudes of the voltage steps as they feed the load K, such as, for example, 25, 50 or 100 volts, along the ordinates of the diagram of FIG. 3.

The electronic circuit also includes additional transistors T2, T4 and T6, which, together with the earlier-described transistors T1, T3 and T5, constitute the amplifiers for the signals transmitted to the respective multivibrators U1, U2, U3.

The earlier-explained point S constitutes the output of the adder circuit where the three signals from the multivibrators are summed up. These signals, by means of a further transistor T7, are coupled to an optoelectronic isolating device Z, leading to the input of the zero-crossing amplifier A. This, as will be readily understood, separates the circuits of the vibrators and of the transistors from the subsequent amplifier, rectifier unit and other associated circuitry.

As can be readily understood by following the circuit of FIG. 5, the AC supply energizes the various elementary circuits by means of transformers TR1 and TR3, through the intermediary of rectifiers W1, W3 and W4 (the output rectifying unit W2 having been mentioned earlier). A group of elements including the transformer TR1, a bridge rectifier D4 and a capacitor C4 forms a current source for transistors T10, T11 which are connected to one section of a pulse transformer TR2 (in the neighborhood of the unit W2). Another section of this transformer is fed by the bridge W2 and is connected to auxiliary electrodes of controlled diodes D1, D2 of the bridge, which are of the S.C.R. type, as mentioned before.

The rectifier bridge unit W2, by means of the pulse transformer TR2 and a flywheel diode D5, controls the load K across its terminals, which load, as will be readily understood, corresponds to the winding K of the electromagnet 20 of the device illustrated in FIG. 1.

FIG. 5 furthermore includes a few conventional elements which will be mentioned hereafter for the sake of completeness only. Signal lamps L1, L2 respectively indicate the presence of AC input voltage and of the actuation of the electromagnet K, the latter with a varying intensity, depending on the voltage that reaches the coil of the magnet. There are various resistors R1 . . . R32, for biasing and voltage reducing purposes, in addition to those three that were mentioned earlier, and which will be self-explanatory to those familiar with circuits of this kind. There are also capacitors C1 . . . C13 in addition to the earlier-mentioned capacitor C4, performing conventional functions in the circuits of the vibrators U1 . . . and the transistors. The circuit also includes diodes D3 and D21 . . . D24, where rectification of signals is necessary, as well as transistors T8 and T9, the latter in the output circuit of the amplifier A, before reaching the earlier-mentioned transistors T10, T11.

The circuitry of FIG. 5 is considered to be straightforward, relatively simple and easy to understand on the basis of the preceding circuit description and the operational particulars that follow hereafter.

The operational description that was given earlier with respect to FIGS. 1 and 2 related only to the mechanical aspects of the actuating device. From here on, the same will be explained with further reference to the electronic control circuit that forms part of the inventive device.

The feeding operation must be performed in accordance with predetermined standards to be established each time, considering the reactions and the mixing speeds of the components that are being examined, and also in accordance with the chemical-physical characteristics of these components.

During the performance of an analysis and the observation of the mixing procedure of the two or more liquids, the keeper 18 has to move, i.e. to be displaced between the two end positions thereof, namely the initial and the final position, at two or more than two different speeds.

The feeding device, schematically shown in FIG. 4, is capable of feeding the winding K with a voltage of a variable intensity, during variable lengths of time, the time periods being adjustable to ensure faster and slower displacement speeds of the keeper, as required. When the speed is fast, it increases progressively, beginning from the initial position, to increase toward the final position, where the keeper 18 comes into physical contact with the pole shoe of the electromagnet 20.

The magnet may be combined with other windings that can be fed by units similar to A through W2, in order to feed the winding of the magnet 50, thereby obtaining counter-reactions on the keeper 18.

The earlier-mentioned optoelectric isolator Z is designed to separate and isolate the monostable vibrators U1 . . . U3 from one another, and also from the rectifying and controlling unit W2, and at the same time to ensure the necessary connection between these units, namely the amplifiers constituted by the three exemplary transistor stages. It should be understood that different alternating and continuous pulse currents circulate in different parts of the electronic circuit. The use of the isolator Z obtains very short response times without any inertia, this being an advantage that cannot be obtained with the use of other, known isolating elements. These usually consist of transformers which have electrically separated windings, which however are necessarily inductively coupled to one another.

In FIG. 5, the continuous pulse-current signals of the vibrators U1 . . . are therefore in synchronism with those applied by the diode bridge W2 to the winding K of the electromagnet.

The operation of the inventive device can be further explained as follows. The chambers 12, 13 are filled with the liquids that are to be mixed and examined. The potentiometers P1, P2, P3 are adjusted according to the times of intervention to be obtained, and during which predetermined amounts of feed voltages are to be applied to the winding K. The voltage values can be adjusted and determined by operating the variable resistors R5, R8 and R11.

Having accomplished the above preparations, the switch S2 is momentarily operated to start the feeding unit. A positive potential is thereby applied to the three or more vibrators, that provide for the emission of signals with different amplitudes, according to the adjustment made to the potentiometers. Thus, signals of different amplitudes are emitted that are transmitted through the transistors and checked by the transistors T2, T4, T6 at the point S of the circuit where they are inserted and mixed. Thereafter they are applied through the isolator Z to the amplifier A, the outlet of which latter connects to the primary winding of the pulse transformer TR2.

The latter has two secondary windings, as shown, that connect to the respective gates constituted by the controlled diodes D1, D2 of the unit W2 that feeds the winding or windings K. As a consequence of the winding being fed by voltages that successively increase during predetermined lapses of time, during which the keeper 18 of the electromagnet moves away from the initial position to reach the final position, the accelerated speed is determined by the variations of the voltage that feeds the winding.

It should be noted that it is possible to obtain the displacement of the piston stem 11 by means of the circuit shown in FIG. 5, with variable speeds and within extremely short lapses of time, in the range of milliseconds, an operation that can be checked and controlled very precisely, thus attaining special results with regard to the speed of reaction that occurs between the two or more liquids that are injected into the mixing chamber 34.

The following considerations should be borne in mind in respect of the construction and operation of the inventive actuating device having an electronic control circuit.

1. Supposing that the winding of the electric magnet or magnets is fed with a constant, continuous voltage, the pole shoes and hence the pistons of the injectors are displaced with a uniformly accelerated motion that is determined by the formula $$F = 2\frac{B^2S}{2\mu O} \tag{1}$$

wherein $$B = \frac{\mu NI}{2L} \tag{2}$$

wherefore $$F = \frac{\mu O(NI)^2S}{4L^2} \tag{3}$$

wherein

L is the width of the gap formed between the pole shoes and the keeper,

B is the magnetic induction, $\mu$ is the magnetic permeability,

NI is the number of the ampere turns of the winding of the electro-magnet, and

S denotes the section of the magnetic core.

With reference to the formula (3) above, and bearing in mind that L is in the denominator, it appears evident that the force F of magnetic attraction is inversely proportional to the amplitude of the square of the gap.

The same formula (3) also demonstrates that a piston-stroke speed of the injectors is at its maximum just an instant before the pistons come to a standstill at the end of their strokes. This condition is extremely important in connection with the purely chemical scopes of the mixture of the various liquids, when mixing is performed according to the present application.

2. The invention also provides the possibility of varying and controlling the displacements of the keeper of the electric magnet in relation to the criteria according to which the mixing operation of the two or more liquids is to be performed. Such a variable control is realized by varying both the feeding voltage and the time during which that voltage is applied to the windings of electric magnets. It will be seen that this actually constitutes varying the path or course of the curve as shown in the diagram of FIG. 3 where the parameters V and T are plotted. It follows that the injector piston can be shifted, first with an accelerated motion, and successively with a retarded motion, or vice versa, in accordance with the criteria to be followed during the particular liquid mixing operation.

In order to check the displacement of the pistons by acting upon the voltage and/or the time, use is made of the circuits shown in FIG. 5 and, in particular, of the components of the units A (amplifier) and W2 (rectifying and controlling unit).

Unit A is designed to intervene on the alternating current that is rectified by the successive unit W2 so that the voltage variation and/or the opening of the feed circuit for the electromagnet K occurs when the current feeding the device A crosses the zero point or passes next thereto.

3. By the arrangement of the inventive device, the injectors can be controlled, providing substantial improvements and advantages over known systems. As a matter of fact, the devices known in the prior art require the use of actuating units necessitating considerable space due to the fact that the actuating means therefore have to be of the pneumatic type and be provided with pressure chambers of a certain volume. Such chambers have to resist relatively high operating pressures which, in practice, may be likely to attain five to eight atmospheres overpressure.

In order to obtain satisfactory results in the liquid mixing operation, the pneumatic actuating means have to be equipped with intercepting members as well as valves that have very short opening and closing times, capable of resisting the high pressures to which they are subjected.

Such intercepting members, if they are of the pneumatic type, do not operate satisfactorily, or they operate only under strictly controlled conditions, while they require careful supervision. In particular, they do not allow the opening and closing times to be checked so as to provide the possibility to pilot and to displace the injector pistons in accordance with predetermined requirements.

On the other hand, the present invention realizes extremely short injecting times that can be checked satisfactorily as well as adjusted, as required, modifications being possible without difficulty and within a relatively short time.

The inventive device may have several mixing chambers, shown in FIG. 1 only by way of example with the two mixing chambers A and B. In practice, there could be three or more mixing chambers for treating three or more liquids.

The inventive device meets the following major requirements.

1. Highest possible mixing efficiency of the two or more liquids is to be attained in relation to the displacement to which the pistons of the injectors are subjected, as well as the displacements of the mixing chamber or chambers into which the liquids are conveyed to be mixed therein.

2. The liquids to be mixed are imparted high velocities in such a way that, for a predetermined liquid volume, the time passing between the beginning of the mixing operation and the arrival at the observation area 35 of the device, where the mixed liquids can inter-act, be very short, namely in the range of between 0.5 and 3 thousandths of a second, as compared to the distance between the mixing chamber and the same point of observation.

3. It is necessary in certain cases to vary the velocity of flow of the liquids being mixed, in comparison to the injecting time, as well as within ample, well predetermined limits. These requirements are realized by varying the voltage of the electromagnet K during the run performed by the pistons so as to convey the liquids into the mixing chamber in accordance with the desired criteria. As was explained before, the diagram shows in FIG. 3 in its abscissa the times T in thousandths of seconds and, on the ordinate, the voltage V in Volts, by which the electromagnet K is fed. It results from this diagram that the electromagnet is fed initially with 100 Volts, which value is successively reduced, such as after 5 milliseconds, for example, to 50 Volts, and then further reduced, namely after 50 seconds, to about 25 Volts.

4. When it is necessary to measure physical-chemical variations in size at the point of observation (window) in function of time, and also at the end of the stroke of the injecting pistons, shortly before these pistons come to a standstill, namely when the flow speed of the mixed liquids is the highest, this can be performed with the inventive device since the speed of attraction of the keeper of the electric magnet, and hence the displacement speed of the pistons, increases inversely to the distance that exists between the keeper and the pole shoes of the electromagnet, even if the feeding voltage is constant.

It can be realized from the preceding description that the desired condition is automatically realized a few instants before the injection of the liquids to be mixed is stopped. It goes without saying that the required conditions can be modified and varied, such as by providing the pole shoes of the electro-magnet with short-circuiting rings, properly dimensioned and shaped, in order to produce magnetic flows that are in contrast with the magnetic flow generated by the electro-magnet, as was mentioned earlier.

5. As concerns the structure of the electromagnet, the invention preferably provides the same in a horseshoe shape, with two windings that are connected in series, as can be seen in FIGS. 1, 4 and 5 of the accompanying drawings. The section of each pole shoe is of approximately 22 square centimeters, and the magnetic force of attraction that is being developed reaches approx. 100 kilograms. With such an electromagnet, if it is necessary to realize an extremely high velocity of attraction of the pole shoe, it would be necessary to use highest supply voltages for the generation of the high powers that have to occur and yet be effective during the entire time during which the pole shoes reach the expansion of the electromagnet. As a result, overheating occurs that is the cause of changes and alterations of the physicl characteristics of the device being employed.

Such alterations are unavoidably transmitted to the liquids being examined, causing modifications of the chemical and physical features of these liquids. Consequently, the results of the experiments are also altered, thus falsifying the obtained test results.

In the exemplary electronic control circuit shown in FIG. 5, the AC supply voltage is, as a matter of example, 220 V; after the rectifier unit W1 and the resistor R2, a DC voltage of approx. 30 V reaches the common bar that connects the transistors T2, T4 and T6 by way of the diodes D22 . . . D24 and the associated electronic components. It will be understood that the transformers T1, T3 are also fed by 220 V AC. The starting terminals of the pulse transformer TR2 are identified in the conventional manner by dots.

The resistor R2 is preferably dimensioned to support a load of 15 Watts; the feed resistor R17 of amplifier A may be for 8 W. Other electrical parameters do not appear to be critical. The secondary of transformer TR1 may furnish about 10 V AC for feeding the transistor chain between amplifier A and unit W2 (at transistor T11). The $\overline{Q}$ outputs of the vibrators U1 . . . U3 can be left non-connected (or grounded). The output of transformer TR3 is approx. 12 V AC for feeding the rectifier W3 and thence, after suitable filtration, the three (or more) vibrators U1 . . . .

The adjusting potentiometers P1 . . . P3 may be wire-wound with about 10 turns each. As explained before, they control pulse times, while the resistors R5, R8, R11 regulate voltage values for the load K.

6. The device according to the present invention obviates the above-described drawbacks and also others by realizing the feed of the electromagnet by means of appropriate findings, the feeding being such as illustrated in FIG. 4. In the block diagram of this illustration, the feeding device is capable of generating voltages which are developed in function of individually pre-programmed times. It is thus possible to realize, in a particular manner and as frequently as desired, the feeding or energization of the electromagnet that allows the highest take-off speeds of its pole shoes. Subsequently, the attraction of the pole shoes continues with the slightest absorption or use of energy, in particular when the pole shoe in question is next to reaching the end of its stroke.

The inventors have made several experiments and tests with the inventive device, and have prepared a detailed Report from which empirical values can be derived that are conclusive of the novel features and usefulness of the invention.

Other modifications may be introduced into the inventive actuating device having an electronic control, to meet specific requirements of analyses performed from time to time.

For example, the device may be provided with two or more electromagnets, conveniently spaced with respect to keeper 18, and acting on the same, the electric supply circuits of the magnets being caused to close in succession to further accelerate the final travel of the keeper, especially when a substantial limitation of dead time is required. It is evident that the device may be adjusted to automatically perform analyses of the liquids in succession and with the required timing.

It is obvious that the details of the inventive device may be varied without departing from the spirit and scope of the invention.

What we claim is:

1. A device for actuating injectors of liquid mixers of the type used in chemical/physical analysis, in particular according to the so-called stopped-flow method, for treating small amounts of the liquids in the range of a few cubic centimeters, comprising, in combination: dual injector devices having pistons that are operatively connected, by the intermediary of connecting means, the latter including a keeper of at least one electromagnet for simultaneous operation, while chambers of corresponding cylinders are selectively connectable, through a commutable intercepting member, with feeding conduits for the liquids to be mixed, and with at least one mixing chamber; and electronic control means for feeding an electric supply voltage to said at least one electromagnet, which voltage has a stepwise controllable value and duration.

2. The device as defined in claim 1, wherein a magnetic circuit of said at least one electromagnetic is combined with means for modifying the magnetic flux and thus vary the action of the latter on said connecting means.

3. The device as defined in claim 1, wherein said connecting means is attached to said at least one electromagnet and is combined with fluid-pressure operated means to control the travel velocity of said connecting means.

4. The device as defined in claim 1, wherein piston stems of said pistons of the dual injector devices are directly secured to said connecting means.

5. The device as defined in claim 1, further comprising means to control variables relating to injection speed, in order to obtain a substantial reduction of "dead time" and thus by extrapolation of such dead time, reproducibly increase the flow velocity of the liquids.

6. The device as defined in claim 1, wherein said electronic control means has at least two circuits to provide respective steps for the controllable voltage and duration.

7. The device as defined in claim 6, wherein said electronic control means includes monostable vibrators corresponding to the number of said circuits, with means for individually adjusting the controllable voltage values and durations associated with said vibrators.

8. The device as defined in claim 7, wherein said circuits include adjustable transistor means with individual outputs, said electronic control means further including an adder for combining the outputs of said transistor means.

9. The device as defined in claim 8, wherein said electronic control means further includes a pulse transformer associated through at least one of its windings with a rectifier bridge that feeds the supply voltage to said at least one electromagnet, the primary winding of said pulse transformer being fed from the output of said adder.

10. The device as defined in claim 9, further comprising an optoelectric isolator between said adder and said primary winding of the pulse transformer.

11. The device as defined in claim 9, further comprising amplifier means between said adder and said primary winding of the pulse transformer.

12. The device as defined in claim 9, wherein the supply voltage for said at least one electromagnet is derived from opposite DC poles of said rectifier bridge, a flywheel diode being connected across said poles.

* * * * *